United States Patent [19]

Entratter

[11] Patent Number: 4,826,245

[45] Date of Patent: May 2, 1989

[54] PRIVACY CHAIR AND PRIVATE VIEWING SYSTEM

[76] Inventor: Lynda G. Entratter, 12084 Manchester Rd., Ste. 5, St. Louis, Mo. 63131

[21] Appl. No.: 139,326

[22] Filed: Dec. 30, 1987

[51] Int. Cl.[4] ..... A47C 7/62

[52] U.S. Cl. ..... 297/217; 248/1 A; 312/7.2

[58] Field of Search ..... 434/308, 432, 30; 297/217; 312/7.2; 248/1 A, 1 B, 1 C

[56] References Cited

U.S. PATENT DOCUMENTS

| | | | |
|---|---|---|---|
| 3,077,038 | 2/1963 | Williams et al. | 297/217 X |
| 3,233,346 | 2/1966 | Corberg | 434/432 X |
| 3,628,829 | 12/1971 | Heilig | 297/217 |
| 3,762,767 | 10/1973 | Powell | 297/217 |
| 4,685,728 | 8/1987 | Rebollo | 297/184 |
| 4,695,903 | 9/1987 | Serap et al. | 434/308 X |

*Primary Examiner*—James T. McCall

*Attorney, Agent, or Firm*—Kenneth H. Johnson

[57] ABSTRACT

A rotatably mounted chair formed in a generally ovate configuration with conforming ovate opening in one side which may be used with a display such as a television monitor mounted on a support proximal to the chair such that rotation of the chair to place the opening opposite to the display provides a system for private viewing of the display.

13 Claims, 6 Drawing Sheets

PRIVACY CHAIR AND PRIVATE VIEWING SYSTEM

BACKGROUND OF THE INVENTION

Field of the Invention

The present invention relates generally to systems which allow private viewing of television monitors. In particular the present invention provides a booth like environment without a door closure. More specifically in some embodiments the invention includes a seating arrangement and a display console.

In addition to providing a segregated area for viewing a monitor screen, the present system also provides a place where music or dialogue may be heard without earphones. In a similar fashion the present system would be excellent for use as a phone booth or as a study or work area.

In the past, private viewing of television monitors has been accomplished by use of small, hooded television screens, such small televisions now being available with two to five inch screens. The size of the screen has certain inherent disadvantages such as resolution and difficulty of viewing. Another method has simply been to provide a separate room or booth for each monitor to be used. Booths may be unattractive and separate rooms expensive or in some uses, severely restricted or prohibited by ordinance.

The present invention is a relatively inexpensive and attractive system to allow the private simultaneous viewing of several television monitors within the same room. In the alternative, a single unit may be used to provide privacy to a viewer in a room wherein other activities are taking place. The monitor used may be of conventional size for ease of viewing, and the viewer is provided a comfortable chair in which to sit while viewing the monitor.

One advantage of the present system is that the privacy of a booth or closed room is obtained without a door or other closure. It is another advantage of the present invention that a seating position is formed as an integral portion of the system along with control panels and the like. It is a further advantage that the present system is modular, that is, at least a major portion may be conveniently fabricated in a uniform style, size, etc. in a plant, thereby resulting in lower unit cost as well as attractive appearance. Because of the modular nature of the present invention it is not a "built in" or permanent construction and therefor can be easily moved from site to site, which is a particular advantage. It is particular feature of the present invention that the system may be used as a single unit or in combination with other units. A further feature of the present invention is that in an arcade where multiple units are employed to comprise the system fewer attendants can readily supervise the entire room, there is less noise and each person is a participant and not merely an observer of the activites of another. These and other advantages and features will be noted and be apparent from the following descriptions of various embodiments of the present invention.

SUMMARY OF THE INVENTION

Briefly the present invention is a privacy chair and a viewing system comprising said chair and a display. The viewing system of the present invention preferably comprises a television monitor mounted on a support with a privacy chair rotatably mounted in close proximity to the monitor. The privacy chair consists of an outer ovate shell of molded fiberglass or other suitable material which is molded with an inner shell forming a seat having a backrest and armrests and an opening. The control for the monitor may be conveniently located in the chair as on the armrest. Additionally speakers for the monitor may be housed within the chair on either side of the seat at ear level. The ovate shape of the shell and inner configuration provides good acoustics as well as privacy, while retaining the sound within the chair.

DESCRIPTION OF THE PREFERRED EMBODIMENTS

Figure 2:
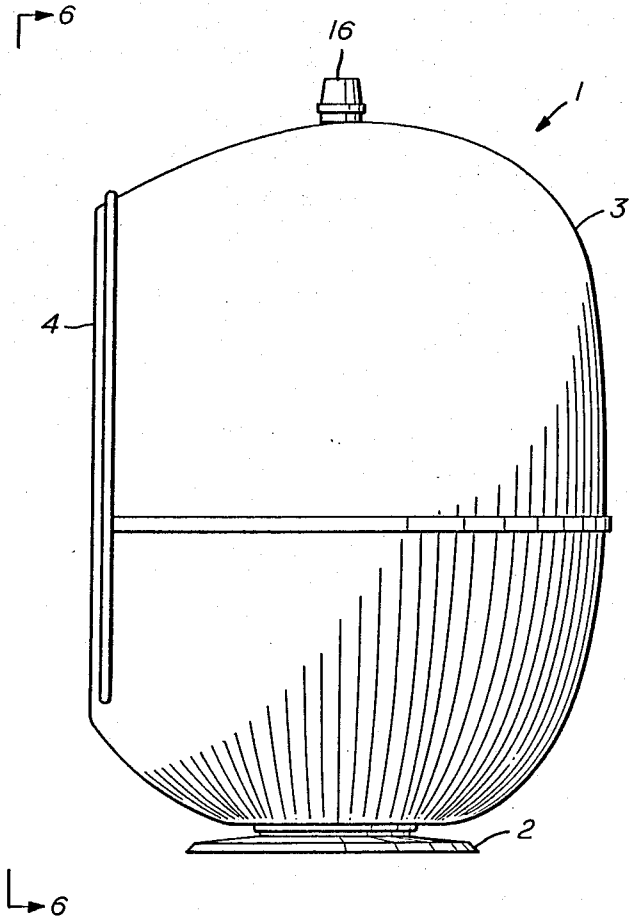
FIG. 2 is a side elevational view of a privacy chair of the invention.

The preferred embodiments are best described with reference to the attached figures in which like components are given like reference numerals. Although the invention is described by reference to specific embodiments, it is to be understood that the claims define the scope of the invention.

Figure 1:
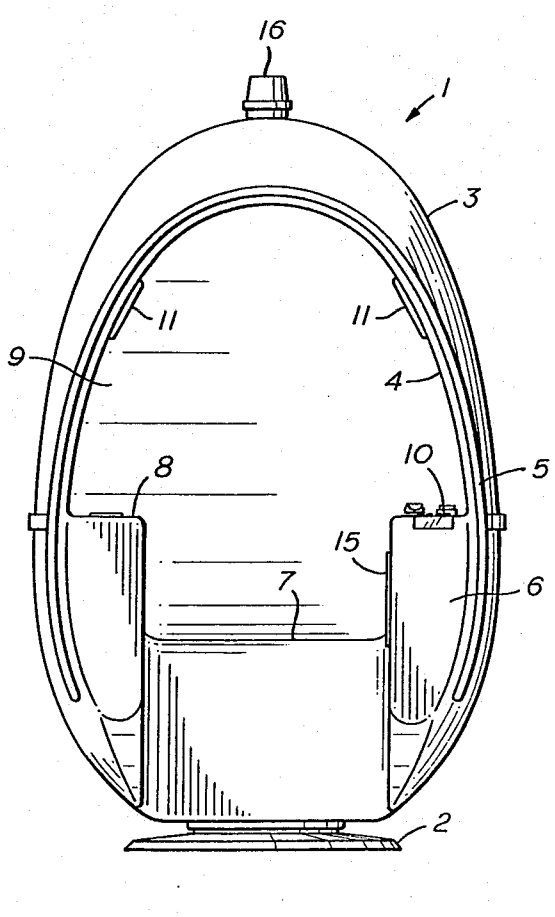
FIG. 1 is a front elevational view of a privacy chair of the invention.
Figure 4:
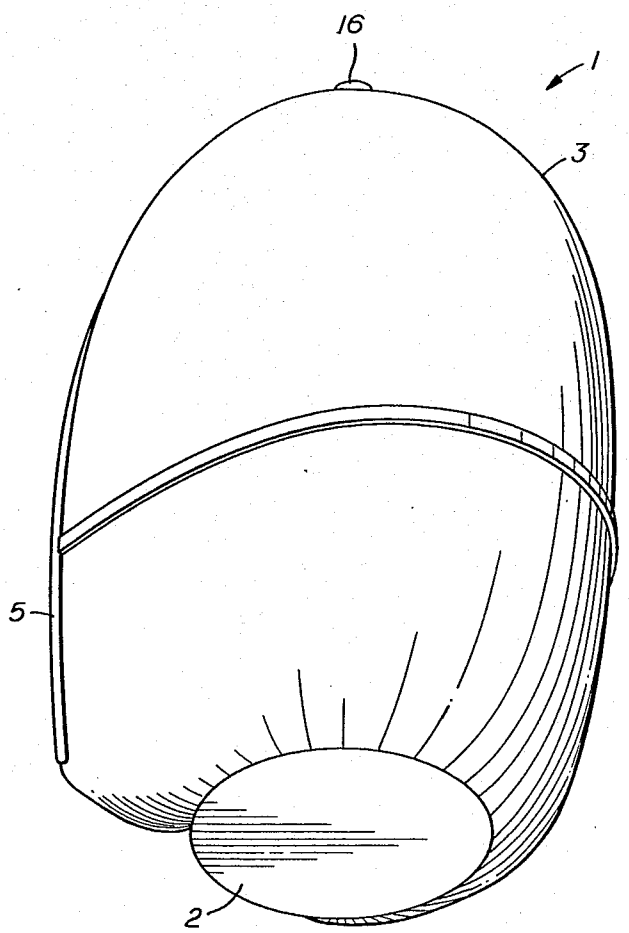
FIG. 4 is a rear perspective view of a privacy chair of the present invention.

The privacy chair as used with the present invention is depicted in FIGS. 1–6, 13 and 14 and generally indicated as 1. FIG. 1 depicts a front view of the privacy chair 1 rotatably mounted on a base 2. As shown in FIG. 1 an outer shell 3 has a general ovate shape when viewed from the front with a conforming ovate opening 4 which generally extends from the base area to a point above a seated user's head (not shown). The opening provides the means for egress to the chair and for private viewing of a display when the chair is rotated to bring the opening opposite to the display. A decorative molding 5 extends about the opening. Integrally molded within the outer shell 6 is an inner shell which forms a seat 7 with armrests 8 and a back 9 at the rear of the shell. Controls 10 for a television monitor are shown in one of the armrests. Speakers 11 which may be connected to a television monitor are shown on either side of the seat approximately at ear level.

FIG. 2 depicts a side view of the chair 1 on the base 2 indicating the outer shell 3 and opening 4. From the side the outer shell forms a general ovate solid with the base of the ovate toward the rear.

Figure 6:
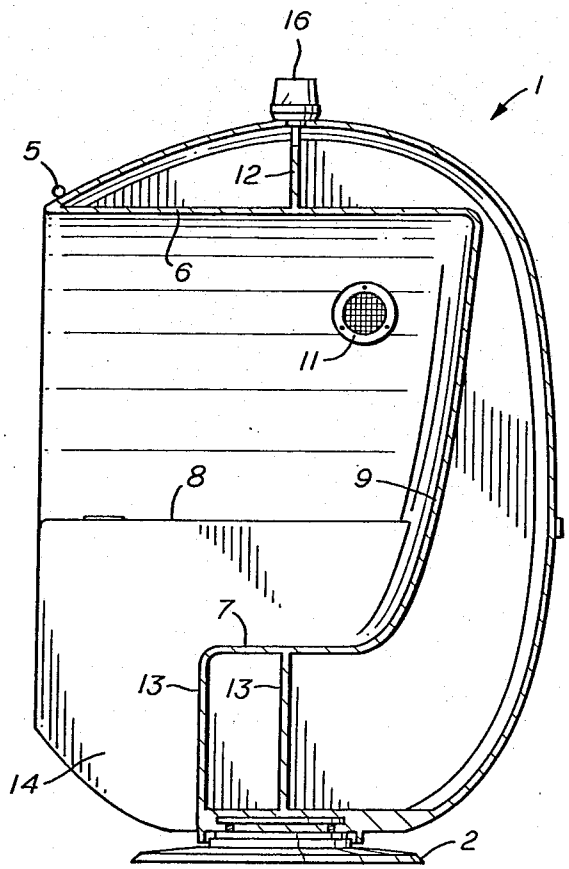
FIG. 6 is a side sectional view of a privacy chair of the invention along line 6—6 of FIG. 2.
Figure 5:
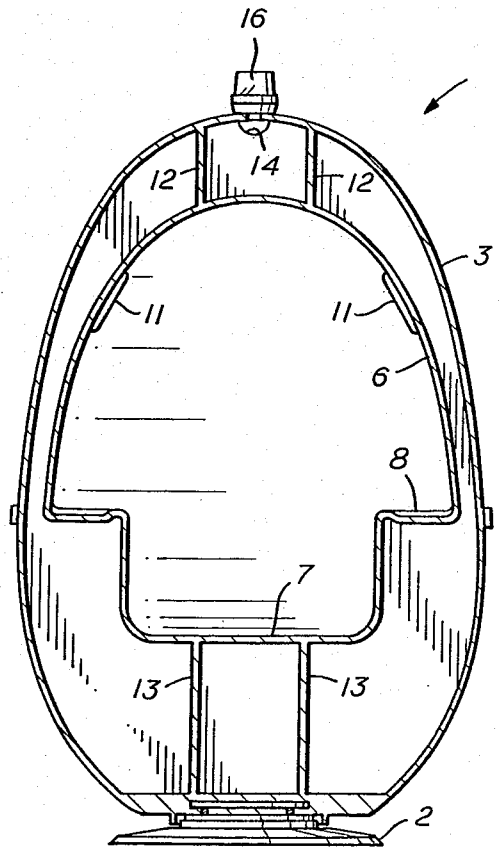
FIG. 5 is a front sectional view of a privacy chair of the invention.
Figure 14:
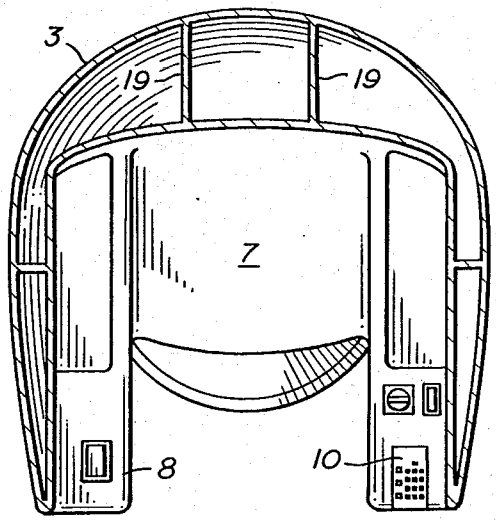
FIG. 14 is a top sectional view of a privacy chair of the present invention.
Figure 13:
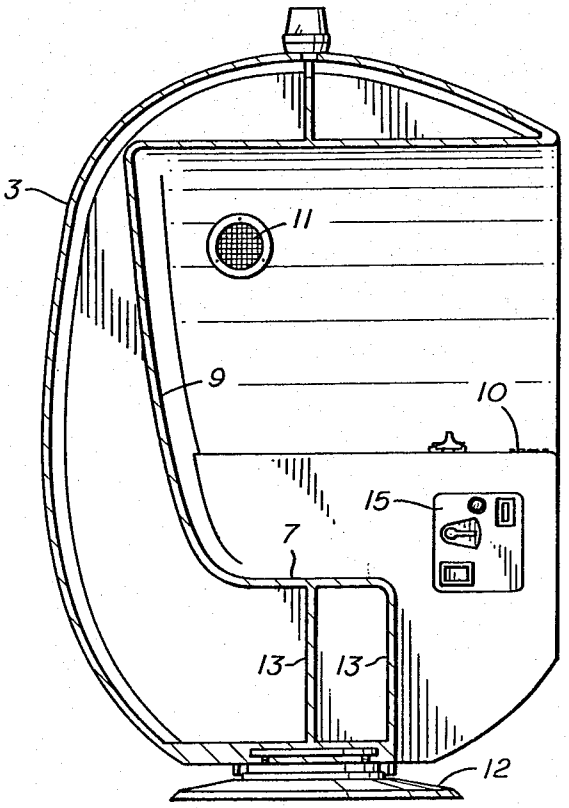
FIG. 13 is a side sectional view of FIG. 2 180° opposite to FIG. 6.

Sectional views of the chair are depicted in FIGS. 5 and 6 wherein the inner shell 6 is more clearly defined showing the seat 7, back 9 and armrests 8. Braces 12 and 13 are shown between outer shell 3 and inner shell 6 for strength. A footwell 14 is provided at the front of the seat. FIG. 13 shows the opposite side of the privacy chair 1 to that shown in FIG. 6 with various controls 10 and 15 mounted to armrest 8. FIG. 14 shows this same embodiment from the top with further braces 19 aiding in holding shell 3 and back 9 rigid.

Figure 3:
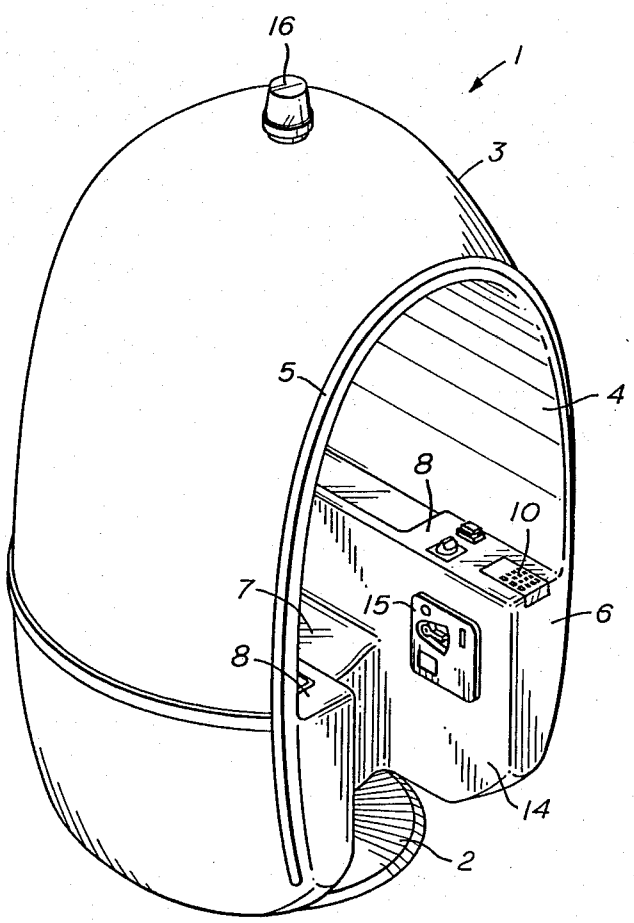
FIG. 3 is a frontal prospective view of a privacy chair of the invention.

A front perspective view of the chair is shown in FIG. 3 indicating the recessed seat 7 and footwell 14. Controls 10 for a television monitor is shown in one of the armrests 8. For convenience, a simple remote control might be incorporated into the armrest. From FIG. 3 it can readiy be seen that a person sitting in the recessed seat 7 would be practically out of view from anyone on either side, the person being almost completely surrounded. The internal configuration is designed to provide good acoustics as well as privacy. The sound from the speakers is retained within the shell while being audible to the user.

Figure 7:
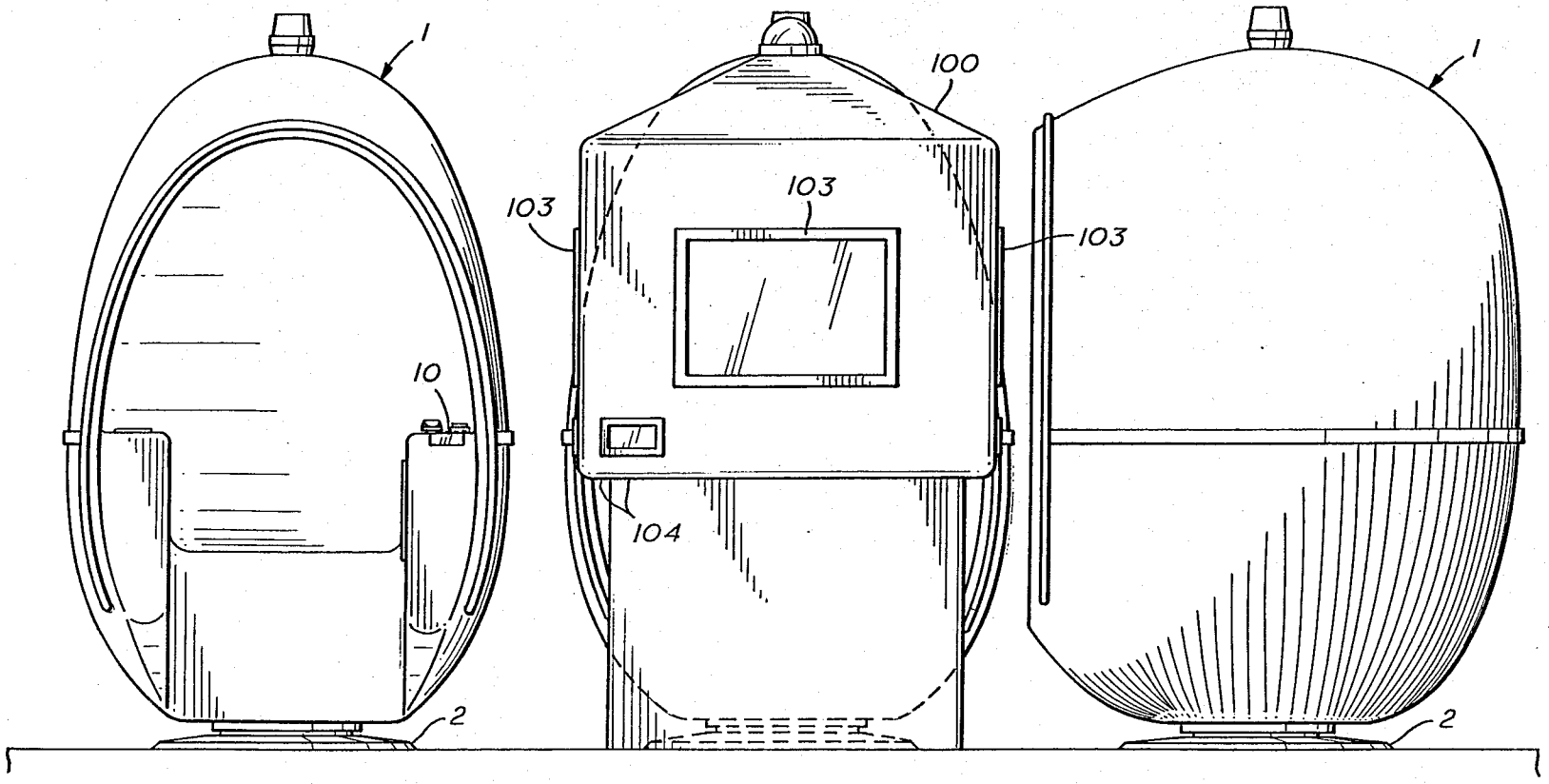
FIG. 7 is a view of one embodiment of the viewing system of the present invention.

FIG. 7 depicts the use of the privacy chair 1 with a multiple viewing system. Shown are privacy chair 1 about a multiple screen monitor station generally indicated at 100. The monitor station 100 in the embodiment shown consists of a rectangular support 101 upon which is mounted a rectangular console 102. In each face of the console is a television monitor 103. The monitor may be connected to any convenient signal device (not shown) such as an antenna, CATV or video tape player. Rotatably mounted directly in front of each monitor is a privacy chair 1. The privacy chairs are mounted as close to the console as possible and still allow the chair 1 to rotate on its base 2. The chair on the left of the console is rotated away from the console to allow entry by the viewer. After the viewer enters the chair it may be rotated back to the viewing position. As shown the console 102 is slightly larger than the support 101 to create an overhang 104 in order to have the monitor 103 as close as possible to the chair 1 and still allow leg room for the viewer when seated in the chair.

Figure 10:
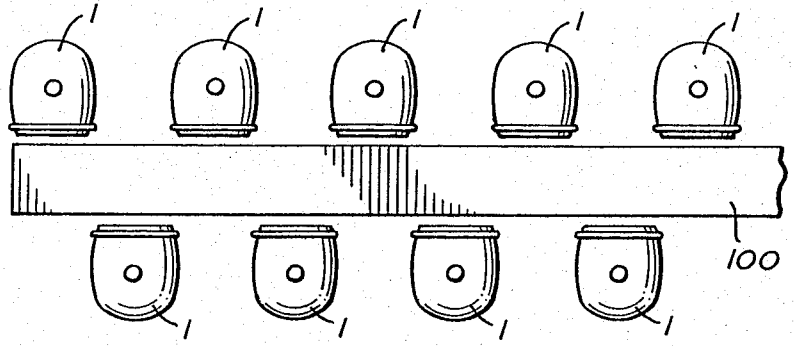
FIG. 10 is an overhead view of another arrangement of the viewing system of the present invention.
Figure 8:
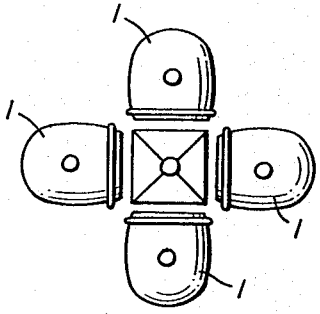
FIG. 8 is an overhead view of one arrangement of the viewing system of the present system.
Figure 11:
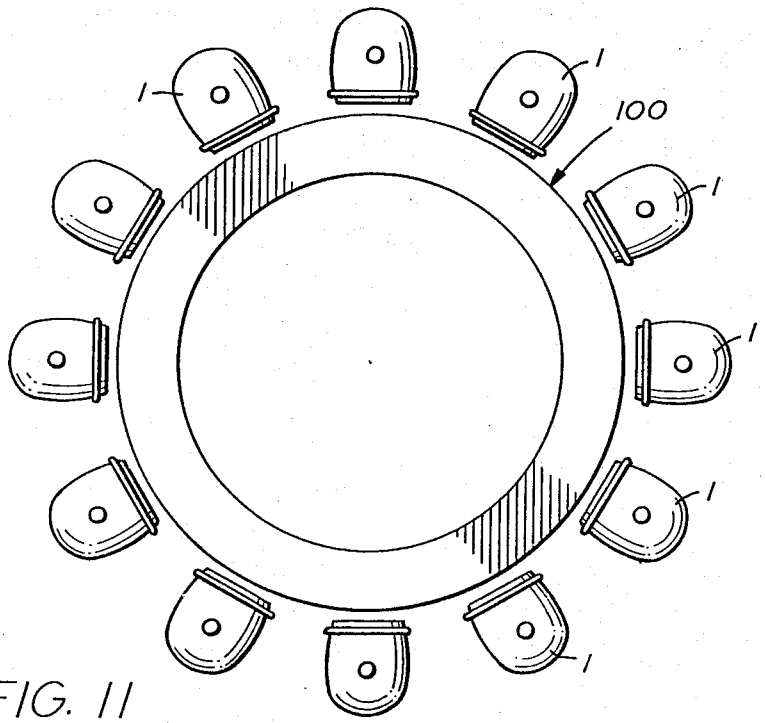
FIG. 11 is an overhead view of yet another arrangement of the viewing system of the present invention.

FIG. 8 shows an overhead view of the arrangement of FIG. 7 including four chairs 1 about the monitor station 100. FIG. 8 indicates the use of two privacy chairs arranged to provide for private conversations for two persons. FIGS. 10 and 11 indicate other arrangements for multiple viewing. The monitor station 100 in FIG. 10 comprises a long rectangular console 102 wherein any number of monitors (not shown) may be used. FIG. 11 discloses a circular monitor station 100 surrounded by a plurality of privacy chairs 1. An arrangement now shown could arrange the privacy chairs on the insde of a circular monitor station.

Figure 12:
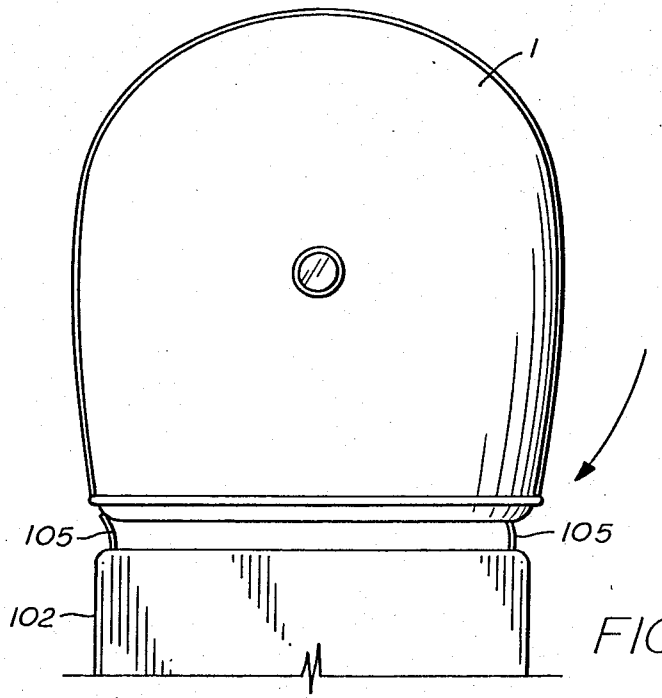
FIG. 12 is an overhead view of another embodiment of the viewing system providing further privacy.
Figure 9:
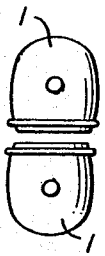
FIG. 9 is an overhead view of an arrangement of the privacy chair of the present invention as used for private conversation.

Finally, FIG. 12 depicts an embodiment providing more privacy for the viewer. Semi-flexible screens 105 extend forward from the top of the monitor console 102 and outward for a sufficient distance to meet the front sides of chair 1. The screen 105 must be flexible enough to allow the chair 1 to rotate to the "open" position. The screen 105 could just as readily be attached to the chair 1.

The usefulness of the invention is not limited to simply viewing a television monitor. The monitor station may be a monitor for a personal computer with the operating keyboard controls in the chair or on a pull out board in the monitor station. This use of the monitor station would be particularly adaptable for word processing in typing pool settings to enhance productivity and for self paced teaching systems.

The monitor station may be used for video games and other commercial uses such as movie rentals. The commercial embodiments would include the pay controls in the console shown at 15 in FIG. 3. Other features and conveniences may be added as needed to make the units attractive and useful. For example, a strobe light 16 which is controlled from within the chair shown in FIG. 3 may be added to call for an attendant. Flashing lights might be placed in the decorative molding 5 of FIGS. 1 and 2 to provide a carnival atmosphere as in an entertainment arcade.

The monitor station may be a display which term is intended to include a monitor screen, a projection screen, a glass or other transparent screen. When used as a study room the display may be omitted and a desk surface provided.

Any number of variations may be contemplated and still fall within the scope of the appended claims.

The invention claimed is:

1. A system to allow private viewing of a television monitor comprising:
   (a) a support means;
   (b) a television monitor mounted on said support means;
   (c) a privacy chair rotatably mounted independently of and in close proximity to said monitor such that the user is out of view when viewing said monitor comprising:
      (i) a base for supporting said chair;
      (ii) a shell rotatably connected to said base, said shell having an opening in the front to allow access by the viewer and to be rotatably alignable with said monitor to form an enclosure;
      (iii) a seat in said shell facing said opening to accommodate the viewer, said seat having a backrest and armrests;
      (iv) controls for said monitor mounted in one of said armrests; and
      (v) audio means for listening to said monitor mounted therein.

2. The system of claim 1 wherein said audio means comprises speakers connected to said monitor and mounted in the walls of said shell on either side of said seat at approximately ear level as a person seated in said seat.

3. A system to allow private viewing of several television monitors comprising in combination:
   (a) a support;
   (b) a plurality of television monitors mounted on said support such that the viewing screens of each of said television monitors faces outward from said support;
   (c) a plurality of privacy chairs, one each of said chairs rotatably mounted independently of and in close proximity to one each of said television monitors such that a user in each chair is out of view of the other users when viewing said monitor, each said privacy chair comprising:
      (i) a base for supporting said chair;

(ii) a shell rotatably connected to said base, said shell having an opening in the front to allow access by the viewer and to be rotatably alignable with said monitor to form an enclosure;

(iii) a seat in said shell facing said opening to accommodate the viewer, said seat having a backrest and armrests;

(iv) control means for each monitor mounted in each privacy chair in closest proximity and viewable from said closest proximity chair, and (v) audio means for listening to said monitor mounted therein.

4. The system of claim 3 wherein said audio means comprises speakers connected to said monitor and mounted in the walls of said shell on either side of said seat at approximately ear level as a person seated in said seat.

5. The system of claim 1 wherein said shell is generally ovate.

6. The system of claim 3 wherein said shell is generally ovate.

7. The privacy chair of claim 1 wherein said privacy chair has a flexible screen attached about a portion of said opening and extending away from said chair.

8. The privacy chair according to claim 1 where a light means is affixed externally to said chair and controlled and operably connected to means to actuate said light means inside said chair.

9. The system of claim 2 wherein said shell comprises an outer ovate shell of molded fiberglass and an inner shell molded with said outer shell to form said opening and said seat.

10. The system of claim 3 wherein each said monitor is connected to a personal computer and said controls comprise the operating console of said personal computer.

11. The system according to claim 1 wherein four of said monitors are mounted one each on a rectangular support.

12. The system according to claim 1 wherein a flexible screen is attached to said support to contact said chair about a portion of said opening.

13. The system according to claim 1 wherein a light means is affixed externally to each said chair and actuated by means mounted inside said chair.

* * * * *